US007089896B2

(12) United States Patent
Diehl et al.

(10) Patent No.: US 7,089,896 B2
(45) Date of Patent: Aug. 15, 2006

(54) DEVICE FOR CONTROLLING GAS EXCHANGE VALVES

(75) Inventors: Udo Diehl, Stuttgart (DE); Bernd Rosenau, Tamm (DE); Simon Kieser, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 412 days.

(21) Appl. No.: 10/451,873

(22) PCT Filed: Jul. 18, 2002

(86) PCT No.: PCT/DE02/02630

§ 371 (c)(1),
(2), (4) Date: Dec. 8, 2003

(87) PCT Pub. No.: WO03/038245

PCT Pub. Date: May 8, 2003

(65) Prior Publication Data

US 2004/0079308 A1 Apr. 29, 2004

(30) Foreign Application Priority Data

Oct. 24, 2001 (DE) ..... 101 52 503

(51) Int. Cl.
*F01L 9/02* (2006.01)

(52) U.S. Cl. ..... 123/90.12; 123/90.13; 123/90.15

(58) Field of Classification Search ..... 123/90.12, 123/90.13, 90.24, 90.15; 251/28
See application file for complete search history.

(56) References Cited

U.S. PATENT DOCUMENTS 5,572,961 A * 11/1996 Schechter et al. ..... 123/90.12

FOREIGN PATENT DOCUMENTS

DE 198 26 047 12/1999

* cited by examiner

*Primary Examiner*—Thomas Denion
*Assistant Examiner*—Zelalem Eshete
(74) *Attorney, Agent, or Firm*—Kenyon & Kenyon LLP

(57) ABSTRACT

A device for controlling gas exchange valves of an internal combustion engine, which has hydraulic valve positioners, each having a positioning piston acting on the gas exchange valve and two hydraulic working chambers, delimited by the positioning piston, of which the first working chamber, for closing the gas exchange valve, is continuously filled under fluid pressure and the second working chamber, for opening the gas exchange valve, is alternately filled and emptied with pressurized fluid via a first and second electrical control valve. To reduce the number of control valves, which may be necessary, for a valve pair, the filling of the second working chamber of the second valve positioner is performed via the second working chamber of the first valve positioner, which is connected to the first control valve, after a predetermined stroke of the positioning piston of the first valve positioner to open the assigned gas exchange valve.

7 Claims, 1 Drawing Sheet

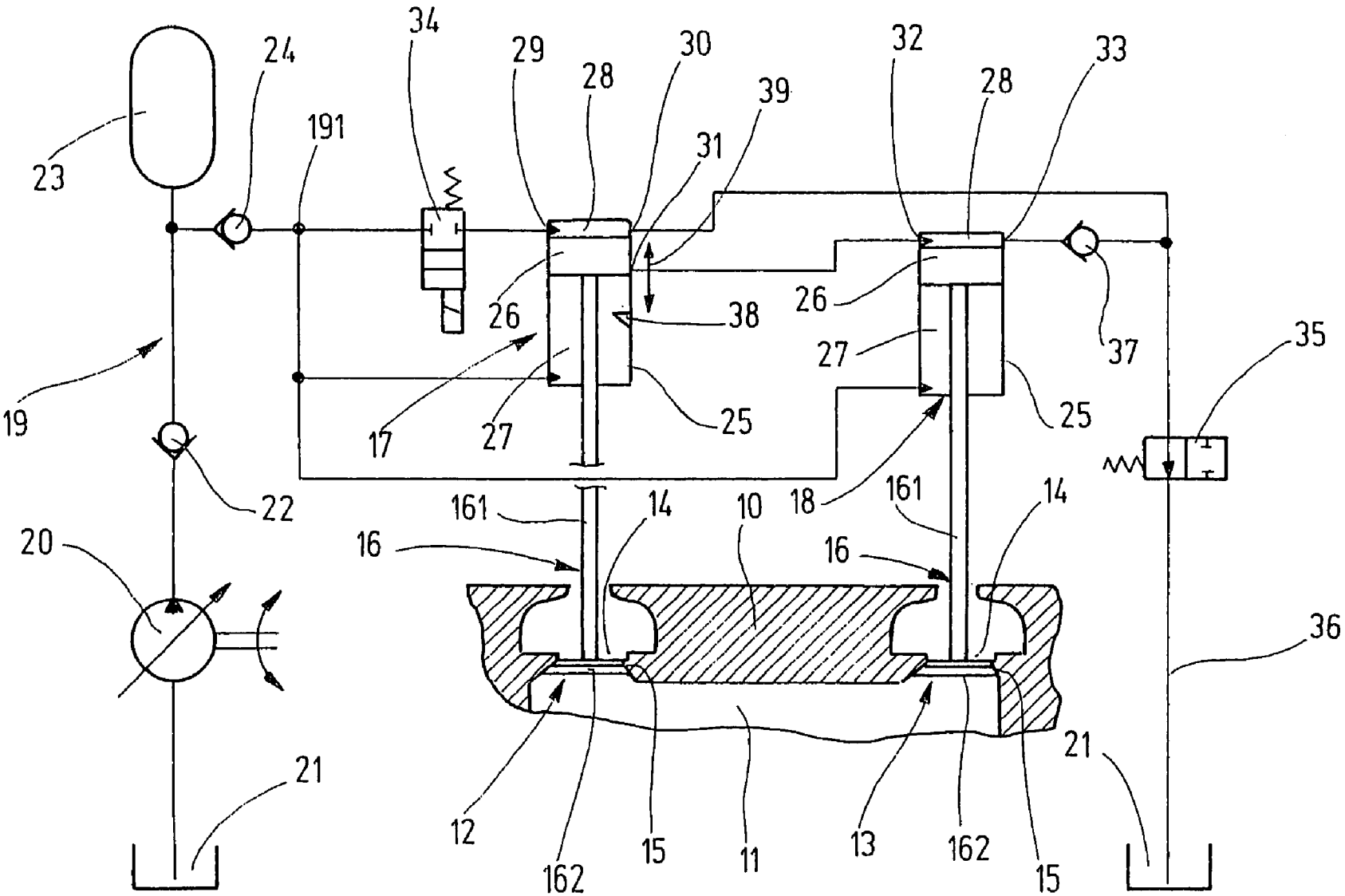
35
36
37
33
25
21
14
15
28
162
32
161
16
13
26
27
18
39
10
11
38
25
30
31
14
15
28
162
29
26
27
161
12
34
17
16
191
24
22
21
23
19
20

DEVICE FOR CONTROLLING GAS EXCHANGE VALVES

FIELD OF THE INVENTION

The present invention is directed to a device for controlling gas exchange valves in combustion cylinders of an internal combustion engine.

BACKGROUND INFORMATION

In a device such as that discussed in German Patent Application No. 198 26 047 A1, each valve positioner, whose positioning piston may be connected in one piece with the valve tappet of the assigned gas exchange valve, may have its first working chamber continuously connected to a high-pressure source. Each valve positioner may have its second working chamber connected to a first electrical control valve, which alternately closes or releases a supply line to the high-pressure source, and to a second control valve, which alternately closes or releases a relief line. The electrical control valves may be implemented as 2/2 directional-control solenoid valves having spring return. In the event the control valves are without current, the first working chamber may still be under high pressure, while the second working chamber may be disconnected from the high-pressure source and may be connected to the relief line. The gas exchange valve may be closed. To open the gas exchange valve, both control valves may have current applied to them. Through the changeover of the control valves, the second working chamber of the valve positioner may be shut off in relation to the relief line by the second control valve and connected to the high-pressure source by the first control valve using the supply line. The gas exchange valve may open, the size of the opening stroke may be a function of the implementation of the electrical control signal applied to the first electrical control valve and the opening speed may be a function of the pressure introduced from the high-pressure source. In order to keep the gas exchange valve in a specific open position, the first control valve may subsequently be deenergized, so that it may shut off the supply line to the second working chamber of the valve positioner. In this manner, all of the valve opening positions of the gas exchange valve may be set using an electrical control unit for producing control signals. Two electrical control valves, which apply hydraulic pressure to the assigned valve positioner appropriately, may be necessary for controlling each gas exchange valve.

SUMMARY OF THE INVENTION

The device according to an exemplary embodiment of the present invention for controlling gas exchange valves may have the advantage that through the direct hydraulic coupling of the second working chambers of two valve positioners of a pair of valve positioners to convert the hydraulic energy into a linear movement of the gas exchange valves, the number of control valves required for controlling two valve positioners may be reduced from four to two. Since in this manner the number of output stages required in the electronic control unit for activating the control valves may be halved, and therefore the wiring cost may also be reduced, the manufacturing costs for the control device may be significantly reduced overall. In addition, the installation space required may be reduced by dispensing with components and wiring, the probability of breakdown of the control valves may be reduced through the lower number of valves, and both the hydraulic and the electrical energy required may be reduced.

According to an exemplary embodiment of the present invention, the two gas exchange valves actuated by the first and second valve positioners may be situated in the same combustion cylinder of the internal combustion engine. This may have the advantage that the power surplus of the second valve positioner for opening the assigned gas exchange valve may not have to be dimensioned as high as that of the first valve positioner, which may need to open the assigned gas exchange valve against the maximum counterpressure occurring in the combustion cylinder, but may be dimensioned lower, since the counterforce for opening the second gas exchange valve of the same combustion cylinder may have already been partially reduced via the open first gas exchange valve.

According to an exemplary embodiment of the present invention, at least the first valve positioner may have a mechanical stroke limiter, which may be dimensioned in such a manner that it blocks further stroke movement of the positioning piston in the valve opening direction after release by the positioning piston of the outlet on the first valve positioner connected to the second working chamber of the second valve positioner. Such a stroke limiter in the first valve positioner may be energetically advantageous if the maximum opening cross-section of both gas exchange valves is still sufficient for the full-load range; if the positioning piston in the first valve positioner is blocked, the entire power surplus may be used to displace the positioning piston in the second valve positioner and to open the second gas exchange valve. The stroke speed of both gas exchange valves may be a function of pressure and may be influenced by the overlap of the strokes in connection with the release of the outlet in the second working chamber of the first valve positioner to the second working chamber of the second valve positioner. In this manner, a speed characteristic of the gas exchange valves which may be a function of pressure and stroke results.

BRIEF DESCRIPTION OF THE DRAWING

The FIGURE illustrates an exemplary embodiment of the present invention and shows a circuit diagram of a device for controlling two gas exchange valves in a combustion cylinder of an internal combustion engine.

DETAILED DESCRIPTION

Using the device for controlling gas exchange valves which is illustrated in the circuit diagram in FIG. 1, a pair of gas exchange valves 12, 13, which may be positioned in a combustion cylinder 10 of an internal combustion engine, may be controlled to optimize energy as a function of an operating map of the internal combustion engine. Gas exchange valves 12, 13 may be intake valves or exhaust valves which seal a combustion chamber 11, implemented in combustion cylinder 10, gas-tight. Each gas exchange valve 12, 13 may have, in a conventional manner, a valve seat 15 which may enclose an opening cross-section 14 in the combustion cylinder and a valve element 16 having a valve closing body 162, seated on an axially displaceable valve shaft 161, which may work together with valve seat 15 to close and release opening cross-section 14. By displacing valve shaft 161 in one axial direction or the other, valve closing body 162 may lift off of valve seat 15 or may press against valve seat 15.

The device for controlling both gas exchange valves 12, 13, which is illustrated in the drawing in a block diagram, may have a first valve positioner 17, which may actuate gas exchange valve 12, and a second valve positioner 18, which may actuate gas exchange valve 13. Each of the two hydraulic valve positioners 17, 18, also called actuators, may engage on valve shaft 161 of one of the two gas exchange valves 12, 13. The valve control device may also include a pressure supply device 19, which may include a regulatable high-pressure pump 20 that may convey fluid, hydraulic oil, for example, from a fluid reservoir 21, a non-return valve 22, and a pressure accumulator 23. A continuous, regulatable high pressure may act on output 191 of pressure supply device 19, tapped between non-return valve 22 and pressure accumulator 23, which a second non-return valve 24, having a passage direction pointing toward output 191, may also be connected upstream from.

Both hydraulic valve positioners 17, 18 may be implemented identically and may be each implemented as a double-acting working cylinder having a cylinder housing 25 and a positioning piston 26 guided axially displaceably therein, which may divide the inside of cylinder housing 25 into a first working chamber 27 and a second working chamber 28. Both first working chambers 27 of both valve positioners 17, 18 may be permanently connected to output 191 of pressure supply device 19. Second working chamber 28 of first valve positioner 17 may have an inlet 29 and two outlets 30, 31, second outlet 31 being positioned at a stroke distance from first outlet 30 such that in the closed position of positioning piston 26 illustrated in FIG. 1, in which it has caused closing of gas exchange valve 12, second outlet 31 may be sealed by positioning piston 26 and may only be released to second working chamber 28 after a predetermined opening stroke of positioning piston 26 for opening gas exchange valve 12. Second working chamber 28 of second valve positioner 18 may have an inlet 32 and an outlet 33. Inlet 29 on first valve positioner 17 may be connected via a first control valve 34 to output 191 of pressure supply device 19. First outlet 30 of first valve positioner 17 may be connected to the valve input of a second control valve 35, whose valve output may be connected to a return line 36 to fluid reservoir 21. Inlet 32 on second valve positioner 18 may be connected, using second outlet 31 on first valve positioner 17 and outlet 33 on second valve positioner 18, to the valve inlet of second control valve 35 via a non-return valve 37. The passage direction of non-return valve 37 may point from outlet 33 to second control valve 35. Both control valves 34, 35 may be implemented as 2/2 directional-control solenoid valves having spring return.

The mode of operation of the valve control device is as follows:

If, as shown in the drawing, first control valve 34 is closed and second control valve 35 is open, both second working chambers 28 of valve positioners 17, 18 may be unpressurized and the high pressure of pressure supply device 19 existing in first working chambers 27 of valve positioners 17, 18 may ensure that positioning pistons 26 are located in their upper final stroke position and may thus keep gas exchange valves 12, 13 in their closed position. In this upper final stroke position or closed position, positioning piston 26 in first valve positioner 17 may seal second outlet 31, connected to inlet 32 on second valve positioner 18.

If control valves 34, 35 are switched over, second working chambers 28 of both valve positioners 17, 18 may be shut off from return line 36 and second working chamber 28 of first valve positioner 17 may be connected to output 191 of pressure supply device 19. Since the area of positioning piston 26 delimiting second working chamber 28 may be greater than the working area of positioning piston 26 in first working chamber 27, the high pressure existing in second working chamber 28 may cause positioning piston 26 to move downward and lift valve closing body 162 off of valve seat 15 via valve shaft 161, so that gas exchange valve 12 opens.

Depending on the operating point of the internal combustion engine, different opening cross-sections 14 may need to be provided in combustion cylinder 10, i.e., only one gas exchange valve 12 or both gas exchange valves 12, 13 may need to be activated using a larger or smaller stroke. If a larger opening cross-section is required, outlet 31 may be released by positioning piston 28 after a defined stroke of positioning piston 26 in first valve positioner 17, so that high pressure may now also build up in second working chamber 28 of second valve positioner 18. The power excess in second working chamber 28 thus acting on positioning piston 26 in second valve positioner 18 may now displace positioning piston 26, so that valve element 13 may also open.

Both outlets 30, 31 may be spaced optimally on first valve positioner 17 with regard to energy as a function of the operating characteristics map of the internal combustion engine. It may also be possible to make the stroke distance of both outlets 30, 31 controllable, in that, for example, second outlet 31 may be placed in a positioning ring, displaceable on cylinder housing 25, which may be connected liquid-tight to second working chamber 28. A lifting drive, controlled by an electronic control unit which may also control both control valves 34 and 35, may engage on the positioning ring. The axial displaceability of second outlet 31 in relation to first outlet 30 may be symbolized in the drawing by a double arrow 39 assigned to second outlet 31. Alternatively, multiple second outlets 31, which may be sealable in sequence by the positioning ring, may be positioned one behind another in the stroke direction of positioning piston 26.

The stroke height of particular gas exchange valve 12 or 13 upon opening may be primarily a function of the activation duration of first control valve 34. In the event of longer activation, a mechanical stroke limiter may engage, which may be at least provided in first valve positioner 17. The stroke limiter, which is only schematically indicated in the drawing as stop 38, may be dimensioned, for example, so that positioning piston 26 in first valve positioner 17 may be prevented from further stroke movement in the valve opening direction shortly after releasing outlet 31 to second working chamber 28 of second valve positioner 18. Such a stroke limiter may be energetically advisable, since then only hydraulic energy may still be necessary for displacing positioning piston 26 in second valve positioner 18. A requirement for such a stroke limiter may be that the sum of opening cross-sections 14 in both gas exchange valves 12, 13 still achievable through the stroke limiter may be sufficient for the full-load range of the internal combustion engine.

The stroke speed of both gas exchange valves 12, 13 may primarily be a function of pressure and may be influenced by the overlap of the strokes and the release of the connection between first working chambers 28 of both valve positioners 17, 18.

What is claimed is:

1. A device for controlling gas exchange valves in a combustion cylinder of an internal combustion engine, comprising:

hydraulic valve positioners, each of which is assigned to one of the gas exchange valves, each of the hydraulic valve positioner including a positioning piston and hydraulic working chambers, the positioning piston being for actuating one of the gas exchange valves and for delimiting the hydraulic working chambers, a first working chamber of the hydraulic working chambers being for actuating an assigned gas exchange valve in a closing direction and for being continuously fillable by a pressurized fluid, a second working chamber of the hydraulic working chambers being for actuating the assigned gas exchange valve in an opening direction and for being alternately fillable and emptiable by the pressurized fluid via first and second electrical control valves;

wherein a second working chamber of a second valve positioner of a pair of valve positioners is fillable via a second working chamber of a first valve positioner, the second working chamber of the second valve positioner communicating with the first control valve following a predetermined stroke of the positioning piston of the first valve positioner in an opening direction of the assigned gas exchange valve.

2. The device of claim 1, wherein:

the second working chamber of the first valve positioner includes an inlet connected to the first control valve, a first outlet connected to the second control valve, and a second outlet connected to the second working chamber of the second valve positioner, the second working chamber of the second valve positioner being connected via a non-return valve to the second control valve, the non-return valve having a shutoff direction towards the second working chamber of the second valve positioner; and the second outlet is positioned in the second working chamber of the first valve positioner at a stroke distance from the first outlet such that the second outlet is sealed by the positioning piston of the first valve positioner in a closed position, the positioning piston of the first valve positioner in the closed position being configured to cause the assigned gas exchange valve to close, and the second outlet is released after the predetermined stroke of the positioning piston in the opening direction, the positioning piston of the first valve positioner in the open position being configured to cause the assigned gas exchange valve to open.

3. The device of claim 1, wherein a mutual stroke distance of the two outlets on the first valve positioner is variable, a variability of the mutual stroke distance being controllable.

4. The device of claim 2, wherein the second working chamber of the second valve positioner includes a further inlet connected to the second outlet of the first valve positioner, and an outlet connected to the non-return valve.

5. The device of claim 2, wherein the first valve positioner includes a mechanical stroke limiter dimensioned so that, after the second outlet is released by the positioning piston, the mechanical stroke limiter blocks further stroke movement of the positioning piston in the opening direction.

6. The device of claim 1, wherein the two gas exchange valves actuatable by the first and second valve positioners are situated in a same combustion cylinder.

7. The device of claim 2, wherein the gas exchange valves assigned to the first and second valve positioners operate as one of an intake valve and an exhaust valve.

* * * * *

UNITED STATES PATENT AND TRADEMARK OFFICE

CERTIFICATE OF CORRECTION

PATENT NO. : 7,089,896 B2
APPLICATION NO. : 10/451873
DATED : August 15, 2006
INVENTOR(S) : Diehl et al.

It is certified that error appears in the above-identified patent and that said Letters Patent is hereby corrected as shown below:

Column 6, line 14, change "of claim 1," to --of claim 2,--

Signed and Sealed this

Twenty-sixth Day of December, 2006

JON W. DUDAS
*Director of the United States Patent and Trademark Office*